US011613939B1

(12) United States Patent
Alamer

(10) Patent No.: US 11,613,939 B1
(45) Date of Patent: Mar. 28, 2023

(54) MODULAR BOWL PROTECTOR

(71) Applicant: Saudi Arabian Oil Company, Dhahran (SA)

(72) Inventor: Mansour Abdullah Alamer, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/484,206

(22) Filed: Sep. 24, 2021

(51) Int. Cl.
*E21B 33/04* (2006.01)
*E21B 17/10* (2006.01)
*E21B 17/12* (2006.01)

(52) U.S. Cl.
CPC ..... *E21B 17/1085* (2013.01); *E21B 17/12* (2013.01); *E21B 33/04* (2013.01)

(58) Field of Classification Search
CPC ..... E21B 33/04
See application file for complete search history.

(56) References Cited

U.S. PATENT DOCUMENTS 2,860,013 A * 11/1958 Medearis ..... E21B 17/105 175/325.6
4,340,259 A 7/1982 Green
5,044,438 A 9/1991 Young
5,109,923 A 5/1992 Koleilat
5,199,495 A 4/1993 Brammer et al.
6,945,325 B2 9/2005 Ford et al.
2019/0242217 A1* 8/2019 Twardowski ..... E21B 17/1007

FOREIGN PATENT DOCUMENTS

CA 2065175 C 4/1995

* cited by examiner

*Primary Examiner* — Giovanna Wright
(74) *Attorney, Agent, or Firm* — Dinsmore & Shohl LLP

(57) ABSTRACT

A method of using a bowl protector assembly includes lowering the bowl protector assembly with a running and retrieving tool into a wellhead located at a surface of a well, whereby a removable upper module of the bowl protector assembly is damaged, wherein the bowl protector assembly comprises the removable upper module and a lower module and the removable upper module comprises tool engagement features to pair with the running and retrieving tool. The method further includes raising the bowl protector assembly out of the wellhead and replacing the damaged removable upper module with an undamaged removable upper module. The method further includes lowering the bowl protector assembly comprising the undamaged removable upper module with the running and retrieving tool into the wellhead and placing the bowl protector assembly on a load shoulder within the wellhead.

5 Claims, 2 Drawing Sheets

MODULAR BOWL PROTECTOR

BACKGROUND

The present disclosure relates to bowl protectors for wellhead assemblies. More specifically, it relates to modular bowl protectors including two separable components to allow for easy replacement in the case of damage.

BRIEF SUMMARY

According to the subject matter of the present disclosure, bowl protectors (also known as a wear bushing) are used in wellhead equipment in which the casing hanger is installed when a casing string has been landed or set. Bowl protectors serve as a temporary protective wellhead component that secures and seals the wellhead equipment (casing head, casing or tubing spools) internal profile sealing surfaces and frequently provides a port to enable communication with the annulus. However, the upper portions of bowl protectors are prone to damage when being run into the wellbore for placement and while running the well drilling assembly through the wellhead equipment. Conventional bowl protectors are one continuous component, and therefore when damaged the entire bowl protector must be replaced. The bowl protectors of the present disclosure address this issue by providing a two piece modular bowl protector where the upper module may be replaced if damaged without replacing the entire bowl protector, thereby increasing the life cycle of the bowl protector.

In accordance with one embodiment of the present disclosure, a method of using a bowl protector assembly includes lowering the bowl protector assembly with a running and retrieving tool into a wellhead located at a surface of a well, whereby a removable upper module of the bowl protector assembly is damaged, wherein the bowl protector assembly comprises the removable upper module and a lower module and the removable upper module comprises tool engagement features to pair with the running and retrieving tool; raising the bowl protector assembly out of the wellhead; replacing the damaged removable upper module with an undamaged removable upper module; lowering the bowl protector assembly comprising the undamaged removable upper module with the running and retrieving tool into the wellhead; and placing the bowl protector assembly on a load shoulder within the wellhead.

In accordance with another embodiment of the present disclosure, a method of using a bowl protector assembly includes lowering the bowl protector assembly comprising a removable upper module and a lower module with a running and retrieving tool into a wellhead located at the surface of a well, whereby the removable upper module of the bowl protector assembly is damaged; raising the bowl protector assembly out of the wellhead; replacing the damaged removable upper module with an undamaged removable upper module; relowering the bowl protector assembly into the wellhead; and placing the bowl protector assembly on a load shoulder within the wellhead, wherein: the removable upper module comprises tool engagement features to pair with a running and retrieving tool, the tool engagement features comprise a subsurface perpendicular groove accessible through a top surface of the removable upper module, the bowl protector assembly comprises connective hardware comprising a plurality of protruding lugs disposed on a first sidewall of the removable upper module and a plurality of interior locking grooves disposed on a second sidewall surrounding a hollow receptacle within the lower module, wherein the plurality of interior locking grooves are structurally configured to permit the plurality of protruding lugs to enter the plurality of interior locking grooves in a vertical direction and lock into place with horizontal movement, and the bowl protector assembly comprises anti-detach hardware comprising a fastening plate bolted to the first sidewall of the removable upper module and the second sidewall surrounding the hollow receptacle within the lower module.

BRIEF DESCRIPTION OF THE SEVERAL VIEWS OF THE DRAWING

The following detailed description of specific embodiments of the present disclosure can be best understood when read in conjunction with the following drawing, where like structure is indicated with like reference numerals and in which.

DETAILED DESCRIPTION

The wellhead of a wellbore includes all permanent equipment between the uppermost portion of the surface casing and the tubing head adapter connection. A conventional surface wellhead configuration includes a casing head housing, casing head spool(s), tubing head spool, tubing bonnet and a production tree, which are installed in stages during the drilling phase of a well. A key function of a wellhead is to suspend the casing load at the surface and seal the annuli between the large casings and the small casings. This is accomplished via a casing or tubing hanger, which lands on a load shoulder in the internal profile of the spools.

A conventional bowl protector (or wear bushing) is a hollow cylindrical device that is temporary installed inside the casing or tubing spools to protect their internal profile and critical seal surfaces during drilling operations. Conventional bowl protectors consist of a single component, and when damaged the entire bowl protector must be replaced. The upper section of conventional bowl protectors is prone to damage when being run in hole. This typically results in irreparable damage to the bowl assembly, which must then be entirely replaced. The present disclosure addresses this issue by providing a two piece modular bowl protector assembly including a replaceable upper module and a lower module. The bowl protector assemblies of the present disclosure allow for the upper module to be replaced if there is damage without discarding the entire bowl protector assembly.

Figure 1:
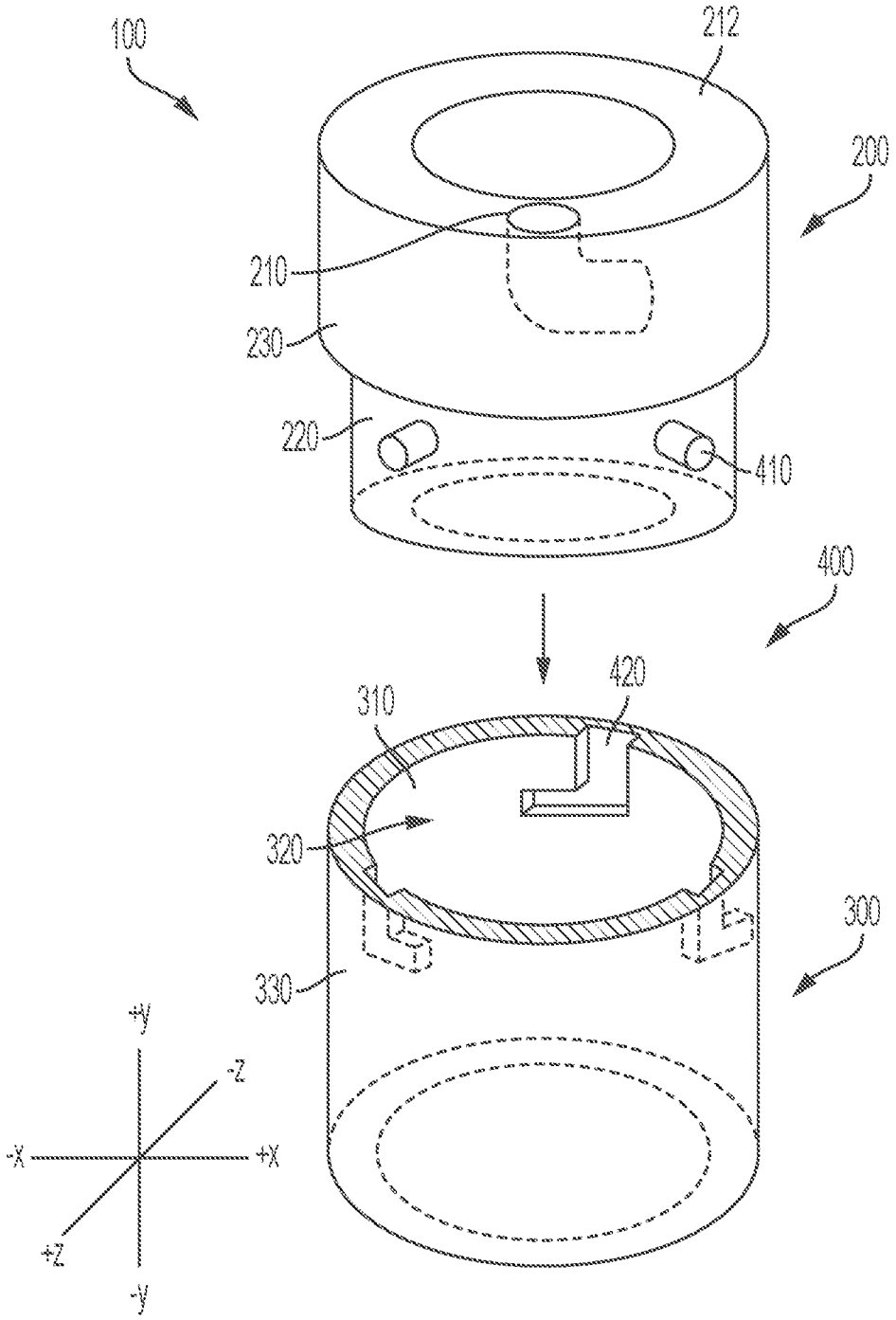
FIG. 1 illustrates a bowl protector assembly, according to one or more embodiments described in this disclosure.

Referring initially to FIG. 1, a bowl protector assembly 100 is shown. The bowl protector assembly 100 includes a removable upper module 200 and a lower module 300. The removable upper module 200 and the lower module 300 are substantially cylindrical in shape with a hollow center to accommodate the drillpipe when in use. When the removable upper module 200 and the lower module 300 are securely connected, the outer profile of the bowl protector assembly is smooth to promote ease of running and retrieving and reduce snagging within the wellhead. In embodiments, the bowl protector assembly may include steel, steel alloy, carbon steel, or combinations thereof, as nonlimiting examples.

The removable upper module 200 comprises tool engagement features 210. The tool engagement features may include a subsurface perpendicular groove 210 accessible through a top surface 212 of the removable upper module 200. The subsurface perpendicular groove 210 is configured to engage with a running tool to enable running, placement, and retrieving within the wellbore. In embodiments, the running tool may be connected to a bottom end of a drill pipe to run into the wellbore. The running tool may have external lugs to engage with the subsurface perpendicular groove 210 of the removable upper module 200 similarly to how the removable upper module 200 engages with the lower module 300. The running tool may engage the bowl protector assembly 100 by lowering into the perpendicular groove 210 in a vertical direction (substantially along the +/−Y axis) until the running tool contacts a bottom of the perpendicular groove and continues along the profile of the perpendicular groove 210 in a horizontal direction (substantially along the +/−X axis). A plurality of subsurface perpendicular grooves may alternatively be provided.

In embodiments, the bowl protector assembly 100 may further include connective hardware 400. The connective hardware 400 allows for secure connection between the replaceable upper module 200 and the lower module 300 of the bowl protector assembly 100. The connective hardware 400 includes a plurality of protruding lugs 410. The protruding lugs 410 are disposed on a first sidewall 220 of the removable upper module 200. The protruding lugs 410 may extend at least 1 centimeter (cm) from a surface of the first sidewall 220. In embodiments, the protruding lugs 410 extend from 1 cm to 5 cm, from 1 cm to 4 cm, from 1 cm to 3 cm, from 1 cm to 2 cm, from 2 cm to 5 cm, from 2 cm to 4 cm, from 2 cm to 3 cm, from 3 cm to 5 cm, from 3 cm to 4 cm, or from 4 cm to 5 cm from the surface of the first sidewall 220. The protruding lugs 410 may have any cross-sectional shape in the XY plane. For example, and not by way of limitation, the protruding lugs 410 may have a circular (as shown), ovoid, rectangular, square, or triangular cross-sectional shape in the XY plane. In embodiments, the plurality of protruding lugs 410 are equidistantly spaced along a circumference of the first sidewall 220.

The connective hardware 400 further includes a plurality of interior locking grooves 420. The plurality of interior locking grooves 420 are disposed on a second sidewall 310 surrounding a hollow receptacle 320 within the lower module 300. The plurality of interior locking grooves 420 are structurally configured to permit the plurality of protruding lugs 410 to enter the plurality of interior locking grooves 420 in a vertical direction (substantially along the +/−Y axis) and lock into place with horizontal movement (substantially along the +/−X axis). For example, the replaceable upper module 200 may be lowered in a vertical direction until the protruding lugs 410 of the replaceable upper module 200 enter the interior locking grooves 420. The replaceable upper module 200 may then be twisted along the XZ plane to lock into place. As the protruding lugs 410 and the plurality of interior locking grooves 420 are contemplated to interact to securely connect the replaceable upper module 200 and the lower module 300, the number of protruding lugs 410 equal the number of interior locking grooves 420. There may be at least 2 protruding lugs 410 and 2 interior locking grooves 420. In embodiments, there may be 3 protruding lugs 410 and 3 interior locking grooves 420 (as shown), 4 protruding lugs 410 and 4 interior locking grooves 420, 5 protruding lugs 410 and 5 interior locking grooves 420, or 6 protruding lugs 410 and 6 interior locking grooves 420. There may be as many as 10 protruding lugs 410 and 10 interior locking grooves 420.

In embodiments, the bowl protector assembly 100 may further include anti-detach hardware comprising a fastening plate bolted or otherwise fastened to the bowl protector assembly 100 connecting the removable upper module 200 and the lower module 300. The fastening plate may be fastened via any method known to one skilled in the art. In embodiments, the fastening plate may be fastened to the first sidewall 220 of the removable upper module 200 and the second sidewall 310 surrounding the hollow receptacle 320 within the lower module. In embodiments, the fastening plate may be bolted between the first sidewall 220 and the interior locking groove 420 after the protruding lug 410 is twisted into place. It is contemplated that the fastening plate may keep the removable upper module 200 and the lower module 300 connected while in use.

In embodiments, the bowl protector assembly 100 may include sealing elements (not shown) placed on an exterior surface of the bowl protector assembly (the sealing elements may be placed on a first exterior surface 230 of the removable upper module 200, a second exterior surface 330 of the lower module 300, or both). The sealing elements may include elastic, polymer, or both, such as an elastomer. For example, the sealing elements may include rubber. The sealing elements provide a seal against against the wellhead spool (casing head housing, casing spool or tubing spool) internal profile for anti-rotation purposes or to prevent cuttings generated during drilling operations from accumulating near the wellhead critical seal areas.

Figure 2:
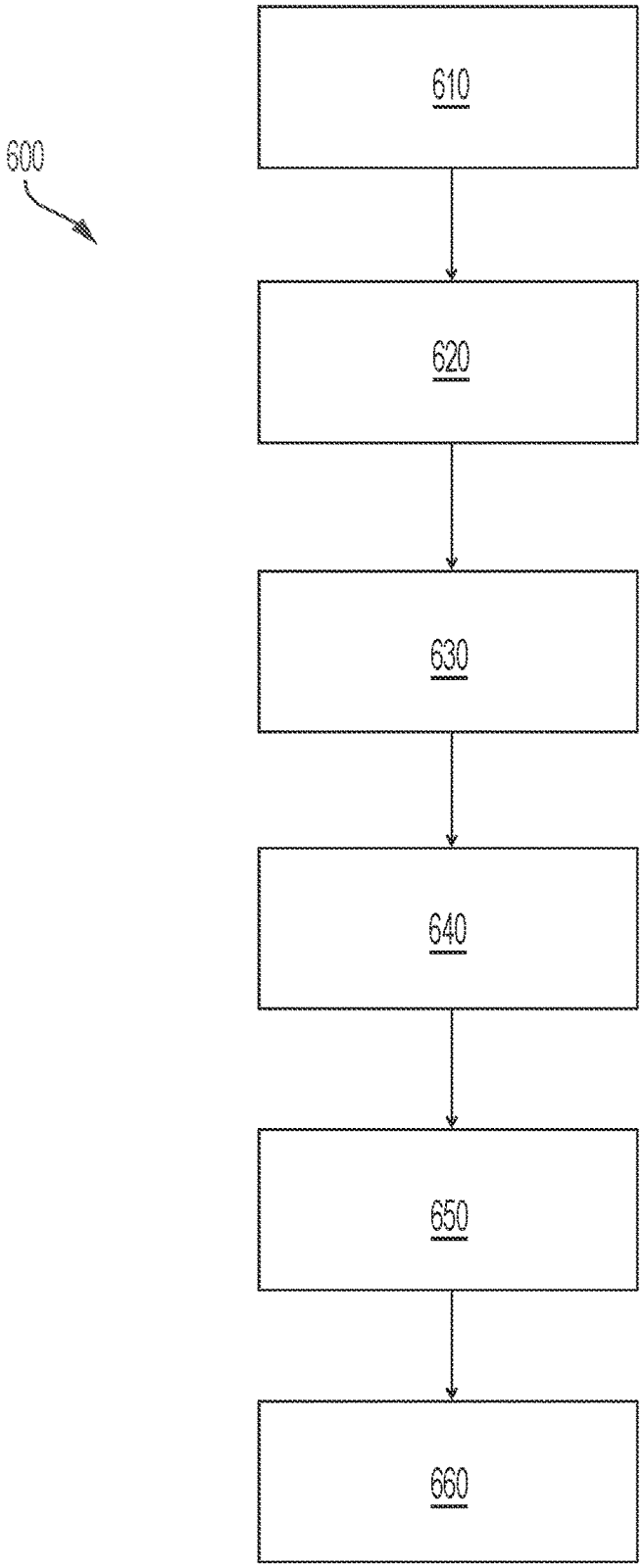
FIG. 2 illustrates a flowchart of the methodology of using a bowl protector assembly, according to one or more embodiments described in this disclosure.

Methods of using the bowl protector assembly 100 are also described. The methodology 600 is shown in FIG. 2. The methods may include lowering the bowl protector assembly 100 with a running and retrieving tool into a wellhead located at a surface of a well (step 610), whereby a removable upper module 200 of the bowl protector assembly 100 is damaged (step 620). It is contemplated that the removable upper module 200 of the bowl protector assembly 100 may be damaged in the form of dents, shear damage, and deep cuts or scores. For example, and not by way of limitation, the subsurface perpendicular groove 210 may be dented or sheared. For ease of description throughout this disclosure method steps may be described as occurring concurrently, though the method steps may occur separately. It is contemplated that the bowl protector assembly 100 may be lowered into the wellhead without resulting in damage. However, for the purposes of illustrating the replaceable nature of the bowl protector assembly 100, the methodology described herein includes damage to the bowl protector assembly 100. The bowl protector assembly 100 may include any of the embodiments previously described. The tool engagement features 400 of the bowl protector assembly 100 pair with the running and retrieving tool as previously described.

The method further includes raising the bowl protector assembly 100 out of the wellhead (step 630) and replacing the damaged removable upper module 200 with an undamaged removable upper module 200 (step 640). In embodiments, replacing the damaged removable upper module 200 with the undamaged removable upper module 200 includes releasing the fastening plate when the fastening plate is present and engaged and twisting the damaged replaceable upper module 200 along the XZ plane to release the replaceable upper module 200 from the lower module 300 and raising the damaged replaceable upper module 200 in a vertical direction until the protruding lugs 410 of the damaged replaceable upper module 200 separate from the lower module 300. The undamaged removable upper module 200 may then be secured to the lower module 300 to form the bowl protector assembly 100 in accordance with previous description.

The bowl protector assembly 100 comprising the undamaged removable upper module 200 is then relowered with the running and retrieving tool into the wellhead (step 650), and placed on a load shoulder within the wellhead (step 660), where the load shoulder has an inner diameter less than the outer diameter of the bowl protector assembly 100.

It is noted that recitations herein of a component of the present disclosure being "configured" in a particular way, to embody a particular property, or to function in a particular manner, are structural recitations, as opposed to recitations of intended use. More specifically, the references herein to the manner in which a component is "configured" denotes an existing physical condition of the component and, as such, is to be taken as a definite recitation of the structural characteristics of the component.

For the purposes of describing and defining the present invention it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is possible that the present disclosure is not necessarily limited to these aspects.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. A method of using a bowl protector assembly, comprising:

lowering the bowl protector assembly with a running and retrieving tool into a wellhead located at a surface of a well, whereby a removable upper module of the bowl protector assembly is damaged, wherein the bowl protector assembly comprises the removable upper module and a lower module and the removable upper module comprises tool engagement features to pair with the running and retrieving tool;

raising the bowl protector assembly out of the wellhead;

replacing the damaged removable upper module with an undamaged removable upper module;

relowering the bowl protector assembly comprising the undamaged removable upper module with the running and retrieving tool into the wellhead; and placing the bowl protector assembly on a load shoulder within the wellhead;

wherein the tool engagement features comprise a subsurface perpendicular groove accessible through a top surface of the removable upper module.

2. The method of claim 1, further comprising producing hydrocarbons from the well.

3. The method of claim 1, further comprising retrieving the bowl protector assembly from the wellhead.

4. The method of claim 1, wherein the bowl protector assembly further comprises connective hardware comprising a plurality of protruding lugs disposed on a first sidewall of the removable upper module and a plurality of interior locking grooves disposed on a second sidewall surrounding a hollow receptacle within the lower module, wherein the plurality of interior locking grooves are structurally configured to permit the plurality of protruding lugs to enter the plurality of interior locking grooves in a vertical direction and lock into place with horizontal movement.

5. The method of claim 4, wherein the plurality of protruding lugs are equidistantly spaced along a circumference of the first sidewall.

* * * * *